US005681620A

United States Patent [19]

Elgarhy

[11] Patent Number: 5,681,620

[45] Date of Patent: Oct. 28, 1997

[54] ENHANCEMENT OF STAIN RESISTANCE OR ACID DYE FIXATION, IMPROVED LIGHT FASTNESS AND DURABILITY OF FIBROUS POLYAMIDE AND WOOL SUBSTRATES

[76] Inventor: Yassin M. Elgarhy, 4109 Mackenzie Court, Chomedey, Laval, Quebec, Canada, H7W 3C9

[21] Appl. No.: 584,121

[22] Filed: Jan. 11, 1996

[51] Int. Cl.[6] ..... B05D 5/00

[52] U.S. Cl. ..... 427/387; 422/81; 422/93; 422/94; 427/389; 427/393.4; 428/96

[58] Field of Search ..... 427/387, 389, 427/393.4; 428/96; 422/87, 93, 94

[56] References Cited

U.S. PATENT DOCUMENTS

| | | | |
|---|---|---|---|
| 3,467,486 | 9/1969 | Soiron et al. . | |
| 3,765,835 | 10/1973 | Clarke et al. | 8/41 A |
| 3,985,923 | 10/1976 | Basadur | 427/390 E |
| 4,195,105 | 3/1980 | Mares et al. | 427/386 |
| 4,209,610 | 6/1980 | Mare et al. | 260/40 R |
| 4,501,591 | 2/1985 | Ucci et al. | 8/495 |
| 4,592,940 | 6/1986 | Blyth et al. | 428/96 |
| 4,822,373 | 4/1989 | Olson et al. | 8/115.6 |
| 4,937,123 | 6/1990 | Chang et al. | 428/96 |
| 5,073,442 | 12/1991 | Knowlton et al. | 428/267 |
| 5,328,766 | 7/1994 | Smith | 428/96 |

FOREIGN PATENT DOCUMENTS

| | | |
|---|---|---|
| 2024600 | 3/1991 | Canada . |
| 975307 | 11/1964 | United Kingdom . |
| WO 88/02042 | 3/1988 | WIPO . |

OTHER PUBLICATIONS

American Dyestuff Reporter, vol. 25, No. 11, Nov. 1993, X.X. Huang et al of the Textile Research Institute, Princeton, New Jersey, U.S.A.

American Dyestuff Reporter, Jun. 1994, pp. 17–21, Johnson et al "Topical Treatments of Nylon Carpets: Fluorochemicals and Stainblockers" Canadian Textile Journal, Mar. 1994, p. 30.

*Primary Examiner*—Ana Woodward
*Attorney, Agent, or Firm*—Swabey Ogilvy Renault

[57] ABSTRACT

Hydrofluorosilicic acid and its water soluble salts enhance the stain resistance or acid dye fixation and resistance to cold water bleeding of fibrous polyamide and wool substrates, for example, carpets, treated with a water soluble sulfonated aromatic-aldehyde condensation resins, for example, sulfonated resole and sulfonated novolak type resins; at the same time an improvement in light fastness or non-yellowing is obtained and the durability or wash fastness of the stain resistance is improved; the condensation resin is optionally employed in conjunction with a polymeric methacrylic acid.

5 Claims, No Drawings

ENHANCEMENT OF STAIN RESISTANCE OR ACID DYE FIXATION, IMPROVED LIGHT FASTNESS AND DURABILITY OF FIBROUS POLYAMIDE AND WOOL SUBSTRATES

BACKGROUND OF THE INVENTION i) Field of the Invention

This invention relates to a fibrous substrate, more especially a polyamide or wool substrate having stain resistance or enhanced fixation of acid dyes, light fastness and wash fastness; to a process for imparting stain resistance or enhanced fixation of acid dyes, light fastness and wash fastness to such a fibrous substrate; to a formulation for enhancing stain resistance or fixation of acid dyes, light fastness and wash fastness of such a fibrous substrate.

ii) Description of Prior Art

Fibrous polyamides and wool are employed in the manufacture of textile products such as carpets which are dyed in a variety of colours or in a pattern defined by colours. Polyamides, notably nylons are in particular widely employed in carpet manufacture.

Such products are frequently exposed to staining by natural and artificial colourants which are commonly found in many foods and beverages.

A number of treatments are available to provide stain resistance in such textile products, for example, carpets, so that the products are resistant to staining by such colourants.

The most efficient stain resisting agents known are resins, in particular, novolak resins, resol resins and condensation products of formaldehyde with dihydroxydiphenyl sulfone and naphthalene sulfonic acid.

The major problem with these kinds of resins when they are used alone as stain resist is that they have a reverse effect on the light fastness and cause yellowing problems on the treated fibers. Much research has been done in an attempt to overcome such problems.

It has been proposed to reduce the amount of dihydroxydiphenyl sulfone and increase the amount of phenol sulfonic acid or naphthalene sulfonic acid, however, the improvement in the yellowing problem and the light fastness was not significant.

The addition of products having a high resistance to oxidation or light, to the stain resist has also been proposed but this improved very slightly the yellowing problem and the light fastness.

Attention has been given to reducing more and more the amount of phenolic resins and replacing them with other stain blockers, for example, polymeric methacrylic acid resins which improved the light fastness and also solved to a great extent the yellowing problem. The disadvantage with these products is the poor wash fastness because the polymeric methacrylic acid resins have poor wash fastness and the low amount of phenolic resin in the product is not enough to provide acceptable wash fastness and light fastness at the same time.

Thus, U.S. Pat. No. 4,592,940 describes the use of a condensation product of formaldehyde, diphenolsulfone and phenolsulfonic acid to provide stain resistance in nylon carpets U.S. Pat. No. 4,501,591 describes a process for continuously dyeing polyamide carpets in which stain resistance is imparted to the carpet during the dyeing by adding an alkali metal silicate and a sulfonated phenolformaldehyde condensation product to the dye liquor used in the dyeing.

U.S. Pat. No. 5,328,766 describes the use of a combination of a partially sulfonated novolak resin and a soluble aluminum salt optionally with a methacrylate polymer to impart stain resistance, light fastness and durability to alkaline wash, to fibrous polyamide and wool substrates.

U.S. Pat. No. 4,822,373 describes the use of a partially sulfonated novolak resin and homopolymers or copolymers of methacrylic acid, to provide resistance to staining by acid colourants in a fibrous polyamide substrate.

U.S. Pat. No. 4,937,123 describes the use of homopolymers or copolymers of methacrylic acid to provide stain resistance to acid colourants in fibrous polyamide materials.

The problem of yellowing and loss of stain resistance in nylon carpets treated with sulfonated phenol or naphthol condensates with aldehydes is described in American Dyestuffs Report, Vol. 25, No. 11, November 1993, by X. X. Huang et al of the Textile Research Institute, Princeton, N.J., U.S.A.

There remains a need to provide stain resistance in conjunction with light fastness and wash fastness in polyamide and wool substrates, such as carpets.

There is a further need to improve fixation of acid dyes to polyamide and wool substrates and enhance cold water bleeding characteristics.

SUMMARY OF THE INVENTION

It is an object of this invention to provide a fibrous polyamide or wool substrate having improved characteristics of stain resistance, light fastness and wash fastness.

It is a further object of this invention to provide a process for imparting stain resistance, light fastness and wash fastness to a fibrous polyamide or wool substrate.

It is yet another object of this invention to provide a formulation for enhancing stain resistance, light fastness and wash fastness.

It is still a further object of the invention to provide a fibrous polyamide or wool substrate exhibiting enhanced fixation of acid dyes and resistance to cold water bleeding, with improved light fastness and wash fastness.

It is yet another object of the invention to provide a process for imparting fixation of acid dyes and resistance to cold water bleeding to a fibrous polyamide or wool substrate.

In still another aspect of the invention there is provided a formulation for imparting fixation of acid dyes and resistance to cold water bleeding, in a fibrous polyamide or wool substrate.

In accordance with one aspect of the invention there is provided a fibrous substrate having stain resistance or enhanced acid dye fixation and resistance to cold water bleeding, together with light fastness and wash fastness comprising: a fibrous polyamide or wool substrate bearing a formulation comprising: (i) a water soluble sulfonated aromatic-aldehyde condensation resin, and (ii) hydrofluorosilicic acid or a water soluble salt thereof.

In accordance with another aspect of the invention there is provided a process for imparting stain resistance, light fastness and wash fastness to a fibrous substrate comprising: (a) contacting a fibrous polyamide or wool substrate with (i) a water soluble sulfonated aromatic-aldehyde condensation product, and (ii) hydrofluorosilicic acid or a water soluble salt thereof, in an aqueous vehicle or medium, (b) allowing components (i) and (ii) to transfer from said aqueous vehicle or medium to said substrate, and (c) drying said substrate.

In accordance with yet another aspect of the invention there is provided a formulation for enhancing stain resistance or acid dye fixation and resistance to cold water bleeding together with light fastness and wash fastness in a fibrous polyamide or wool substrate comprising: i) a water soluble sulfonated aromatic-aldehyde condensation resin, ii) hydrofluorosilicic acid or a water soluble salt thereof, in a vehicle for components (i) and (ii).

In accordance with still another aspect of the invention there is provided a process for imparting a fixation of acid dyes, with enhanced light fastness and wash fastness, and resistance to cold water bleeding to a fibrous substrate comprising: a) contacting an acid dyed fibrous polyamide or wool substrate with i) a water soluble sulfonated aromatic-aldehyde condensation product, and ii) hydrofluorosilicic acid or a water soluble salt thereof, in an aqueous medium, b) allowing components i) and ii) to transfer from said aqueous medium to said substrate, and c) drying said substrate.

DESCRIPTION OF PREFERRED EMBODIMENTS

In accordance with the invention there is employed a sulfonated aromatic-aldehyde condensation product in conjunction with hydrofluorosilicic acid or salt thereof.

In particular embodiments there may additionally be employed a polymeric methacrylic acid, namely, a homopolymer or copolymer of methacrylic acid.

a) Sulfonated Aromatic-Aldehyde

The condensation product or resin may be a sulfonated resole resin, a sulfonated novolak resin or a condensation product of an aldehyde with dihydroxy diphenyl sulfone and naphthalene sulfonic acid.

In these condensation products or resins, the aldehyde is, in particular, a lower aliphatic aldehyde, for example, formaldehyde or acetaldehyde, usually formaldehyde.

The sulfonated resole resin may be produced as the sulfonated condensation product of at least one phenol and at least one aliphatic aldehyde, the condensation being carried out at a pH higher than 7.

Suitable sulfonated resol resins are produced by condensing formaldehyde and phenol in alkaline media at pH of about 9 for about 60 minutes, at about 90° to 110° C., followed by approximately 40% sulfonation of the phenol formaldehyde condensation product with sodium metabisulfite at a pH between 4 and 7 at 90° to 110° C. for about 60 to 90 minutes followed by neutralizing and maintaining at acid pH after the treatment.

A typical sulfonated resin contains repeating units illustrated below:

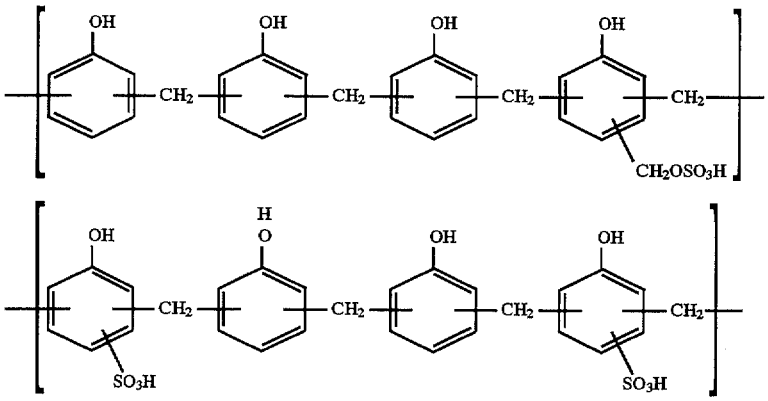

It will be understood that the degree of sulfonation may be varied but will generally be 30 to 50%, preferably 40%.

Suitable sulfonated novolak resins include but are not limited to condensation products of formaldehyde with bis(hydroxyphenyl)sulfone and phenol sulfonic acid.

The ratio of the bis(hydroxyphenyl)sulfone and the phenol sulfonic acid is generally 30 to 50:70 to 50, for example, 50:50, preferably 40:60 and more preferably 30:70.

A typical sulfonated novolak resin is a condensation product of phenolsulfonic acid and dihydroxydiphenyl sulfone with formaldehyde having a repeating unit as illustrated below:

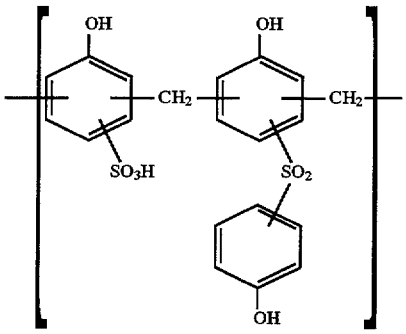

A suitable condensation product of an aldehyde with dihydroxydiphenylsulfone and naphthalene sulfonic acid, is one in which the aldehyde is formaldehyde.

The ratio of the dihydroxydiphenyl sulfone to the naphthalene sulfonic acid is suitably about 25 to 40:75 to 60, for example 40:60, 50:50, preferably 30:70 and more preferably 25:75.

A typical condensation product of naphthalene sulfonic acid and dihydroxydiphenyl sulfone with formaldehyde has a repeating unit illustrated below:

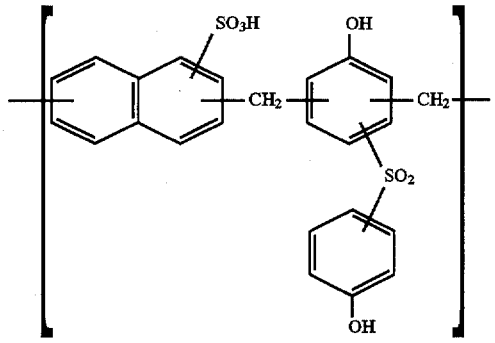

These condensation products are, in particular, water soluble and form aqueous solutions in water.

b) Hydrofluorosilicic Acid and Salts

The sulfonated resin is employed in conjunction with hydrofluorosilicic acid or a salt thereof.

This acid or salt imparts a more durable stain resistance or fixation of acid dyes and resistance to cold water bleeding to the fibrous polyamide or wool substrate when employed in conjunction with the sulfonated resin. The acid or salt is soluble in water, which may be cold water, hot water or water at room temperature. Suitable salts of hydrofluorosilicic acid include salts of light and heavy metals and by way of example there may be mentioned sodium silicofluoride, potassium silicofluoride, aluminum silicofluoride, sodium aluminum silicofluoride, magnesium silicofluoride and copper silicofluoride.

The hydrofluorosilicic acid or its salt when applied in aqueous solution, with the sulfonated resin, promotes to a high degree the exhaustion of the sulfonated resin on the fibers of the fibrous polyamide or wool substrate. The hydrofluorosilicic acid or salt maximizes the precipitation of the sulfonated resins onto the fibers so that exhaustion of the resin onto the fibers is complete and promotes bonding between the sulfonated resin and the fiber thereby rendering the stain resistance durable to washing or enhancing the fixation of acid dyes. Heavy metal ions such as copper also function to promote the affinity between the sulfonated resin and the fiber.

c) Polymers of Methacrylic Acid

In preferred embodiments, especially when the fibrous substrate is a polyamide substrate, the sulfonated resin and the hydrofluorosilicic acid are employed in conjunction with a polymethacrylic acid, namely, methacrylic acid homopolymer or copolymers of methacrylic acid or combinations of methacrylic acid, homopolymer and copolymers of methacrylic acid.

In the case of the copolymers, the comonomer may be a monocarboxylic acid, a polycarboxylic acid, an anhydride, an unsubstituted or substituted ester or amide of a carboxylic acid or anhydride, a nitrile, a vinyl monomer, a vinylidene monomer, a monoolefinic or polyolefinic monomer, a heterocyclic monomer or combination thereof.

Representative comonomers include alkyl acrylates wherein the alkyl group has 1 to 5, preferably 1 to 4 carbon atoms, itaconic acid, acrylic acid, stryene, sodium sulfostyrene and sulfated castor oil. The copolymers may contain one or more comonomers for methacrylic acid.

Representative copolymers of methacrylic acid also include terpolymers of methacrylic acid, sodium sulfostyrene and styrene; methacrylic acid, sulfated castor oil and acrylic acid and methacrylic acid, acrylic acid and sulfated castor oil.

Preferably, the polymeric methacrylic acid comprises about 30 to 100 weight percent of the methacrylic acid. Homopolymers contain 100 weight percent of the metacrylic acid. Copolymers contain about 30 to less than 100, preferably 60 to 90 weight percent of methacrylic acid.

The weight average molecular weight and the number average molecular weight of the methacrylic polymer should be such that satisfactory stain resistance is provided by the polymer in combination with the sulfonated resin and the hydrofluorosilicic acid or its salts. Generally, the lower 90 weight percent of the methacrylic acid homopolymer or copolymer has a weight average molecular weight preferably in the range of about 2500 to about 250,000. Additionally, the lower 90 weight percent of such homopolymer or copolymer preferably has a number average molecular weight in the range of about 500 to 20,000.

d) Formulations

The active agents of the invention, namely the sulfonated resin, the hydrofluorosilicic acid or salt and the optional polymeric methacrylic acid are employed together in a vehicle for their application to the fibrous substrate. Preferably they are employed in an aqueous vehicle.

The active agents may also be employed in a vehicle comprising a resist printing paste. In this way the resist printing paste may be employed to print a printed area on a polyamide or wool substrate, for example, a carpet, and the combination of active agents of the invention prevent staining of the printed area with acid dyes during dyeing.

The relative amounts of the two active agents and the optional third active agent in this invention should be sufficient to provide commercially acceptable stain resistance or enhanced fixation of acid dyes and light fastness and also wash fastness to fibrous polyamide or wool substrates to the desired degree of durability and resistance.

Optimum amounts of the active agents will vary depending on the nature of the substrate.

In general an improvement in stain resistance or enhanced fixation of acid dyes, light fastness and durability or wash fastness is achieved when the water soluble sulfonated aromatic aldehyde condensation product is present on the substrate in an amount of at least 0.008, preferably at least 0.01, and more preferably at least 0.02 weight percent based on the weight of the substrate; and the hydrofluorosilicic acid or salt is present in an amount of at least 0.01, preferably at least 0.02 weight percent based on the weight of the substrate. When the polymeric methacrylic acid is employed it is suitably employed in an amount of at least 0.06, preferably at least 0.12 weight percent based on the weight of the substrate.

By way of example, when the substrate is nylon 66 and a sulfonated resole resin is employed, the resol resin is preferably in an amount of at least 0.008 weight percent, the amount of methacrylic acid polymer, if present, is at least about 0.06 weight percent; and the amount of hydrofluorosilicic acid or its salts is preferably at least about 0.01 weight percent, based on the weight of the substrate.

When the substrate is nylon 6 the amount of the sulfonated resol resin is suitably in an amount of at least 0.02, preferably at least 0.03 weight percent, the amount of methacrylic acid polymer, if present is suitably at least 0.12 weight percent and the hydrofluorosilicic acid or its salt is suitably in an amount of at least 0.02 weight percent, based on the weight of substrate.

When the substrate is wool the sulfonated resol resin is suitably used in an amount of at least 0.02, preferably at least 0.03 weight percent and the amount required from the hydrofluorosilicic acid or its salts is suitably at least 0.02, preferably at least 0.03 weight percent, based on the weight of the substrate; it is found that methacrylic acid polymers provide no significant improvement in the stain resistance of the wool substrates, in the present invention.

Higher amounts of hydrofluorosilicic acid or its salts do not necessarily provide an increased performance of the stain resisting or acid dye fixation of the invention.

When using sulfonated novolak resin on nylon 66 substrate the amount of resin is preferably at least 0.01 weight percent, the amount of the methacrylic acid polymer, if employed, is about at least 0.06 weight percent, and the amount of the hydrofluorosilicic acid or its salts is at least 0.01 weight percent, based on the weight of substrate.

When the substrate is nylon 6 the sulfonated novolak resin is suitably in an amount of at least 0.02 weight percent, the amount of the methacrylic acid polymer, if employed, is at least 0.12 weight percent, and the amount of the hydrofluorosilicic acid or its salts is at least 0.02 weight percent, based on the weight of the substrate.

The hydrofluorosilicic acid or its salts in the invention is preferably used in an amount between 75% to 125%, by weight, of the amount of sulfonated resin.

The sulfonated resins used alone with the hydrofluorosilicic acid or its salts produces almost the same degree of stain resistance or enhanced fixation of acid dyes as methacrylic acid resin with the sulfonated resin.

e) Application

The treatment of the fibrous polyamide or wool substrate can be by different known methods to achieve higher stain resistance, durability or wash fastness and improved light fastness. The results may vary depending upon the method of application. Usually the stain resist can be applied to carpet by the following methods:

1. Exhaust method at a fiber to water ratio between 1:10 and 1:50, preferably between 1:10 and 1:30; the carpet is usually treated for between 20 to 30 minutes at 160° to 170° F.
2. Spray method in which the stain resist is sprayed in combination with fluorochemicals and other agents, for example, as soil release or soil resist agents or antistatic agents.

In this case, the substrate usually contains between 30 to 50% humidity, and, the stain resist and the other additives are sprayed on the carpet, the carpet is dried and then cured without steaming.

3. Continuous Method:

This can be carried out in two different techniques:

a) Pad with 300 to 350%, by weight, pick up, steam for 2 to 3 minutes, light rinse then normal dry.

b) The solution of the stain resist is passed through the carpet to improve the penetration with a pick-up between 200 and 350%, by weight, the carpet is steamed for about 3 minutes, followed by a light rinse and drying.

In all methods the solution of stain resist can be applied at cold or hot temperature.

Similarly in the case of fixation of acid dyes similar known methods are employed whereby the acid dye is first applied to the fabric, for example, by immersion in a bath of the dye, spraying or printing, with the formulation for acid dye fixation thereafter being applied by the same techniques as for stain resistance.

f) Substrate

The substrates employed in the invention are fibrous polyamide or wool substrates. The substrate may be in the form of fibers, yarns or fabrics; the invention has particular value for the case in which the substrate is a carpet, for example, household carpet, commercial and industrial carpet and automotive carpet, The following examples illustrate the invention employing stain resist or acid dye fixation formulations of the invention.

EXAMPLES

The carpet samples used in this illustration are of untreated white nylon 6. The first evaluation method was done by padding where the carpet sample was immersed in a solution of the stain resist at a pH between 2 and 3. The pad pick-up on the carpet was 350%, by weight, of the untreated carpet. The carpet was steamed for 3 minutes at 210° F. or higher without any pressure, washed lightly, squeezed then dried.

The second evaluation method was done by the exhaust method in which the carpet sample was weighed, immersed in a solution of the stain resist with a fiber to water ratio of 1:20, the carpet sample was treated for 20 minutes at a temperature of 170° F. and at a pH of 2 to 3, the carpet sample was then rinsed, squeezed and dried.

Staining test:

The first staining test employs a staining test solution of the sweetened cherry soft drink KOOLAID (Trade Mark). The solution was made by diluting 100 g of KOOLAID in one liter of water. The treated carpet samples were stained with 20 g of the prepared test solution and kept for 16 hours at room temperature, then rinsed for evaluation. The samples were evaluated for staining on a graduated scale from 1 to 8 where 1 represents complete staining and 8 represents complete non-staining of the carpet; usually a stain resistance rating of 5 is considered acceptable, 7 is very good, 8 is excellent resistance to staining. The second staining test (severe test) was carried out by taking 5 g of treated carpet in 200 g of KOOLAID test solution prepared as described above. The solution is heated to 80° C. and the sample kept in the solution for 10 minutes, followed by rinsing and drying.

Light test:

The light test in this invention was made according to the light test method in the AATCC test book No. 1GE 1978 for 40 hours under a xenon arc lamp. The sample exposed to the ultraviolet light is evaluated for light fastness according to a graduated rating scale which ranges from 1 to 5 where rate 5 represents non-yellowing and 1 is very poor with severe yellowing, in general 4.5 is excellent and 4 is acceptable.

Wash test:

The wash test was carried out using 0.1 g/l anionic soap, the solution was adjusted to pH 10 with trisodiumphosphate. The treated carpet sample was exposed to this solution for 45 minutes at 40° C., rinsed, dried and stained as mentioned in the invention evaluated.

The sulfonated resins used to treat the carpet test samples were as follows:

1. Sulfonated resol resin as described above.
2. FX-661 (Trade Mark) a commercially available aqueous solution from Minnisota Mining Manufacturing Co., based on novolak resin and a methacrylic acid polymer.
3. A resin formed by condensing formaldehyde with dihydroxy diphenyl sulfone and phenol sulfonic acid, the ratio of dihydroxy diphenyl sulfone to the phenol sulfonic acid is 30 to 70, the concentration, in weight %, of the novolak resin is 40%, the remainder being water.

The methacrylic acid polymer used for the evaluation has a molecular average weight of 6,000, the concentration, in weight %, in water, of the resin is 30%; the resin is available from Rohm & Haas under the Trade Mark LEUKOTAN.

Evaluation is then by the stain test evaluation in which the stain is evaluated after washing on the scale of 1 to 8 as described for the staining test.

The additional agents used in the Examples were:

1. Hydrofluorosilicic acid (25%, by weight, aqueous solution).
2. Aluminum fluorosilicate (25%, by weight, aqueous solution).
3. Magnesium sulfate $MgSO_4.7H_2O$ (conventionally employed additive).
4. Citric acid $HOOCCH_2COOH.H_2O$ (to control pH).

Acid Dye Fixation or Cold Water Bleeding test:

This test determines the fastness of acid dyes in the fabric when exposed to cold or room temperature water. The wash test described previously can be employed to evaluate acid dye fixation in hot water.

This test may be identified as AATCC Test Method 15–1989 of the American National Standard.

Typically a specimen of dyed substrate is immersed in a test solution for 15 to 30 minutes and squeezed to thoroughly wet the substrate.

The wet substrate is sandwiched between a specimen of the un-dyed substrate and a No. 10 multifiber test fabric. This sandwich structure is exposed to mechanical pressure in a wringer so that the sandwich weights 1 to 1.5 times the dry weight of the fabrics of the sandwich.

Change in colour of the specimen by transfer to the multifiber test fabric is evaluated on a scale of 1 to 5 in which 5 represents negligible or no colour transfer and 1 represents significant colour transfer.

Example 1

The following stain blocker formulations set out in Table 1 were applied to untreated white polyamide nylon 6 carpet samples using the padding method explained in this invention:

TABLE 1

| | Formulation No. | | | | |
|---|---|---|---|---|---|
| ADDITIVE | 1 G/l | 2 G/l | 3 G/l | 4 G/l | 5 G/l |
| Resol resin | 1.5 | | | 1.5 | |
| Novolak resin | | 1.5 | | | 1.5 |
| Leukotan 970 | 14 | 14 | | 14 | 14 |
| FX661 | | | 15.5 | | |
| Hydro fluoro silicic acid* | 1 | 1 | | | |
| Aluminun silico fluoride* | | | | 1 | 1 |
| Magnesium sulfate | | | 3 | | |
| pH | 2.5 | 2.5 | 2.5 | 2.5 | 2.5 |

*25%, by weight, aqueous solution

These five different formulations show the difference when using different catalysts or additives with the stain resists. The test results of the different formulations are shown in Table II.

TABLE II

| | Formulation | | | | |
|---|---|---|---|---|---|
| | No. 1 | No. 2 | No. 3 | No. 4 | No. 5 |
| Stain test | 7.0–8.0 | 8.0 | 7.0 | 7.0–8.0 | 7.0–8.0 |
| Lightfastness | 4.0 | 4.0 | 4.0 | 4.5 | 4.5 |
| Stain test after 1 wash | 7.0 | 7.5 | 6–7 | 7.0 | 7.5 |

TABLE II-continued

| | Formulation | | | | |
|---|---|---|---|---|---|
| | No. 1 | No. 2 | No. 3 | No. 4 | No. 5 |
| Stain test after treating the samples 10 mins. in KOOLAID solution at 80° C. | 5 | 5 | 3 | 5–6 | 5–6 |

The above results show that by applying different catalysts or additives the results of the stain resist, the light fastness and the durability to wash behaves differently; it is clear that by using hydrofluorosilicic acid or a metal salt of the acid better light fastness is obtained, in addition to superior stain resistance and durability to washing. It has been found that by increasing the amount of the hydrofluorosilicic acid or its salts or also the magnesium sulfate does not necessarily increase the performance of the stain blocker. The five formulations show the importance of having the hydrofluorosilicic acid or its salts in the solution of stain blocker to increase the performance and the durability.

Example 2

The following formulations in Table III were applied by the exhaust method; the carpet samples were treated in solution containing the stain blocker at pH 2.5, the fiber to water ratio was 1 to 20, the solution was heated to 170° F. The samples were treated for 20 minutes. The staining test was carried out with the KOOLAID solution described previously, the samples were stained for 16 hours. The pH of all the batches were adjusted to 2.5 by citric acid. The amount of stain blocker or catalyst indicated are all percentages of the weight of the carpet sample.

TABLE III

| | Formulation No. | | | | | | | |
|---|---|---|---|---|---|---|---|---|
| | 6 | 7 | 8 | 9 | 10 | 11 | 12 | 13 |
| Sulfonated resol | | | 2.0 | | | | | 0.2 |
| Methyl methacrylic copolymer 40000 mw | | | | 1.5 | | 1.5 | | 1.5 |
| Sulfonated novolak resin | | 2.0 | | 0.2 | 2.0 | 0.2 | | |
| FX 661 | 2.0 | | | | | | 2.0 | |
| Magnesium sulfate | | | | | 0.5 | 0.5 | 0.5 | 0.5 |
| Stain Test | 3 | 4.5 | 4.5 | 4.5 | 5 | 5 | 4.5 | 4.5 |
| Light fastness | 4 | 2 | 2 | 4 | 3 | 4.5 | 4.0 | 4.5 |
| Stain test after 1 wash | 1–2 | 4 | 4 | 4 | 4 | 4 | 3 | 4 |

Table III above shows that sulfonated novolak resin or resol resin alone impart good stain resistance but poor light fastness; and that by employing a combination of sulfonated novolak resin or resol resin with methacrylic resin or by using a commercial combination, i.e., FX 661 satisfactory stain resistance and light fastness, are obtained.

Example 3

Until now and before this invention the combination illustrated in Table III exhibited the best results for available stain blocker on the market. With this invention the degree of stain resistance and the light fastness and also the third very important factor, namely, durability to wash were improved to a very great extent with the formulations of this invention. Table IV illustrates similar formulations to Table III but additionally employing hydrofluorosilicic acid or its salts.

TABLE IV

| Formulation No. | 14 | 15 | 16 | 17 | 18 | 19 | 20 | 21 | 22 |
|---|---|---|---|---|---|---|---|---|---|
| Sulfonated resole resin | | | | | | 0.2 | 0.2 | 0.2 | 0.2 |
| Methyl methacrylic copolymer 40000 mw | | 1.8 | 1.8 | 1.8 | 1.8 | 1.8 | 1.8 | 1.8 | 1.8 |
| Sulfonated novolak resin | | 0.2 | 0.2 | 0.2 | 0.2 | | | | |
| FX 661 | 2 | | | | | | | | |
| Hydro fluoro silicic acid | | | 0.3 | | | | 0.3 | | |
| *Sodium silico fluoride | | | | 0.3 | | | | 0.3 | |
| *Aluminum silico fluoride | | | | | 0.3 | | | | 0.3 |
| Magnesium sulfate | 0.5 | 0.5 | | | | 0.5 | | | |
| Stain Test | 4.5 | 5 | 7 | 7 | 7 | 5 | 7 | 7 | 7 |
| Light fastness | 4 | 4 | 4.5 | 5 | 5 | 4.0 | 4.0 | 4–5 | 4–5 |
| Stain Test after 1 wash | 3 | 4 | 7 | 7 | 7 | 4 | 7 | 7 | 7 |
| Stain Test after sample are immersed 10 minutes in KOOLAID solution at 80° C. | 2 | 3 | 5 | 5 | 5 | 2 | 5 | 5 | 5 |

*25%, by weight, aqueous solution

In Table IV the formulations 14 to 22 show that the hydrofluorosilicic acid or its metal salts improve the light fastness and the durability to wash dramatically while maintaining the improvement in the stain resistance, after washing.

It is believed that by using the hydrofluorosilicic acid or its salts in combination with stain blocker a state of the art in this field is achieved. This invention will change many conventional methods in the industry and will overcome the light fastness problems and the durability to wash.

By means of the invention it is possible to obtain treated dyed fibrous polyamide or wool substrates, especially carpets, having a stain resistance of at least 5, typically at least 7 on a scale of 1 to 8, a light fastness as determined by non-yellowing of at least 4 on a scale of 1 to 5, by the first staining test and the light fastness test described hereinbefore. Furthermore, the stain resistance of at least 5 is maintained after 1 to 5 washings of the substrate, demonstrating the durability or wash fastness of the stain resistance provided by the invention.

Example 4

The following acid dye fixation formulations set out in Table V were applied to an acid dyed polyamide nylon 66 Fabric sample using the exhaust method explained hereinbefore; with treatment for 20 minutes at 170° F.

TABLE V

| Additive | Formulation No. 1 g/l | 2 g/l | 3 g/l | 4 g/l |
|---|---|---|---|---|
| Novolak resin | 3 | 5 | 3 | 5 |
| *$Al_2(SiF_6)_3$ pH 4–5 | — | — | 3 | 3 |

The test results for colour fastness of the acid dye or water bleeding determined as well as light fastness and wash fastness by the tests described hereinbefore are set out in Table VI:

TABLE VI

| | Formulation No. 1 | 2 | 3 | 4 |
|---|---|---|---|---|
| Wash fastness | 2–3 | 2–3 | 3–4 | 3–4 |
| Light fastness | 2–3 | 2–3 | 4 | 4 |
| Cold water bleeding | 2–3 | 2–3 | 4 | 4 |

*25%, by weight, aqueous solution

I claim:

1. A process for imparting stain resistance, light fastness and wash fastness to a fibrous substrate comprising:

(a) contacting a fibrous polyamide or fibrous wool substrate with a composition consisting essentially of:

(i) an agent providing stain resistance and wash fastness comprising a water soluble sulfonated aromatic-aldehyde condensation product, and (ii) an agent providing wash resistance to a fibrous polyamide or fibrous wool substrate treated with a water soluble sulfonated aromatic-aldehyde condensation resin, which agent is a hydrofluorosilicic acid or a water soluble salt thereof, and (iii) an aqueous vehicle (b) allowing components (i) and (ii) to transfer from said aqueous vehicle to said substrate, and (c) drying said substrate.

2. A process according to claim 1, wherein said agent (i) further includes a polymeric methacrylic acid.

3. A process according to claim 2, wherein said substrate is a nylon 6 or nylon 66 carpet.

4. A process according to claim 1, wherein said substrate is a wool carpet.

5. A process according to claim 1, wherein said sulfonated aromatic-aldehyde condensation product is selected from a sulfonated resole resin, a sulfonated novolak resin or a condensation of an aldehyde with dihydroxydiphenyl sulfone and naphthalene sulfonic acid.

* * * * *